US007730861B2

(12) United States Patent
Ng

(10) Patent No.: US 7,730,861 B2
(45) Date of Patent: Jun. 8, 2010

(54) TWO-STEP ROCKER ARM ASSEMBLY

(75) Inventor: Kwok Y. Ng, Rochester Hills, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 600 days.

(21) Appl. No.: 11/685,495

(22) Filed: Mar. 13, 2007

(65) Prior Publication Data

US 2008/0223324 A1 Sep. 18, 2008

(51) Int. Cl.
*F01L 1/18* (2006.01)

(52) U.S. Cl. ..... 123/90.39; 123/90.44; 74/559

(58) Field of Classification Search ..... 123/90.16, 123/90.39, 90.44, 90.6, 90.48, 90.52; 29/888.2; 74/559, 567, 569

See application file for complete search history.

(56) References Cited

U.S. PATENT DOCUMENTS 6,691,657 B2 * 2/2004 Hendriksma et al. ..... 123/90.39
6,769,387 B2 8/2004 Hayman et al.
6,966,291 B1 * 11/2005 Fischer et al. ..... 123/90.39
7,305,951 B2 * 12/2007 Fernandez et al. ..... 123/90.39

* cited by examiner

*Primary Examiner*—Ching Chang
(74) *Attorney, Agent, or Firm*—Harness, Dickey & Pierce, P.L.C.

(57) ABSTRACT

A two-step rocker arm assembly is provided having an arm member and a first roller assembly rotatably mounted with respect to the arm member and defining a generally C-shaped opening. A shaft member rotatably supports a second and a third roller assembly. The shaft member extends through the generally C-shaped opening and is selectively translatable therein to guide the second and third roller assemblies with respect to the arm member. A coupling lever is mounted with respect to the shaft member and is operable to selectively retain the shaft member with respect to the arm member for unitary movement therewith.

20 Claims, 2 Drawing Sheets

TWO-STEP ROCKER ARM ASSEMBLY

TECHNICAL FIELD

The present invention relates to a two-step rocker arm assembly and valvetrain for an internal combustion engine.

BACKGROUND OF THE INVENTION

Some prior art engine valvetrains are selectively adjustable to vary the amount of valve travel during opening. Typically, such valvetrains are selectively adjustable between a low-lift mode, in which the valvetrain causes an engine poppet valve to open a first predetermined maximum amount (with lost motion), and a high-lift mode, in which the valvetrain causes the poppet valve to open a second predetermined maximum amount that is greater than the first predetermined maximum amount. This adjustability is accomplished with the use of a two-step rocker arm assembly. Prior art two-step rocker arm assemblies typically include an inner and an outer rocker arm assembly operating in contact with a camshaft having two distinct cam profiles, a low-lift cam and a high-lift cam.

SUMMARY OF THE INVENTION

A two-step rocker arm assembly is provided having an arm member and a first roller assembly rotatably mounted with respect to the arm member and defining a generally C-shaped or curved opening. A shaft member is also provided and rotatably supports a second roller assembly, such as a roller bearing. The shaft member extends at least partially into the generally C-shaped opening and is selectively translatable within the generally C-shaped opening to guide the second roller assembly with respect to the arm member. A coupling lever is mounted with respect to the shaft member and is operable to selectively retain the shaft member with respect to the arm member for unitary movement therewith.

A first spring lever may be pivotably mounted with respect to the arm member and engaged with at least one of the shaft member and the second roller assembly. Further a first spring member may be disposed between the first spring lever and the arm member to bias the shaft member with respect to the arm member.

In one embodiment, a third roller assembly, such as a roller bearing, may be rotatably supported by the shaft member. Additionally, a second spring lever may be pivotably mounted with respect to the arm member and engaged with at least one of the shaft member and the third roller assembly. A second spring member may be disposed between the second spring lever and the arm member to bias the shaft member with respect to the arm member.

The first roller assembly may include an inner race and an outer race coaxially disposed with respect to, and spaced from the inner race. A plurality of roller elements are preferably disposed between the inner race and the outer race. The inner race may define the generally C-shaped opening. A latch assembly, having a hydraulically actuated pin, may be provided to selectively engage the coupling lever to selectively retain the shaft member with respect to the arm member for unitary movement therewith. A valvetrain incorporating the two-step rocker arm of the present invention is also disclosed.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
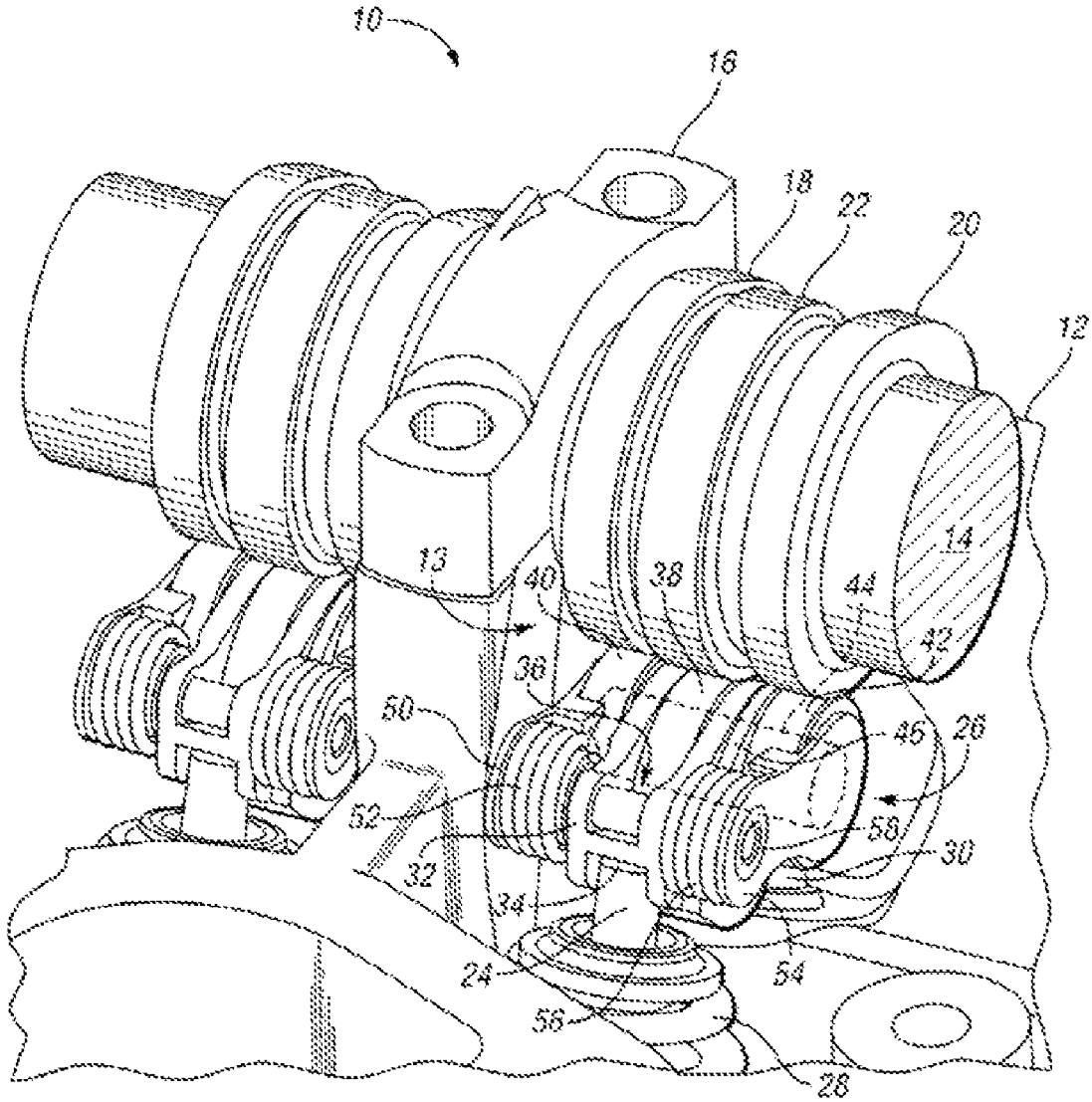
FIG. 1 is a perspective view of a portion of an internal combustion engine having a valvetrain incorporating two-step rocker arm assemblies consistent with the present invention.

Referring to the drawings wherein like reference numbers correspond to like or similar components throughout the several figures, there is shown in FIG. 1 a portion of an internal combustion engine, generally indicated at 10. The internal combustion engine 10 includes a cylinder head 12 having a valve train 13 mounted thereto. The valve train 13 includes a camshaft 14 rotatably mounted with respect to the cylinder head 12 via a cam cap 16. The camshaft 14 includes a first high-lift cam 18 spaced from a second high-lift cam 20 and a low-lift cam 22 disposed therebetween.

The valvetrain 13 further includes a poppet valve 24 at least partially disposed within the cylinder head 12 and selectively openable by a rocker arm assembly 26. The rocker arm assembly 26 is selectively actuated by the camshaft 14. Those skilled in the art will recognize that the poppet valve 24 is operable to selectively introduce an intake charge into the internal combustion engine 10, in the case of an intake valve, or to selectively exhaust products of combustion from the internal combustion engine 10, in the case of an exhaust valve. The poppet valve 24 is biased in a closed position by a valve spring 28. A lash adjuster 30 is provided to account or compensate for lash or excessive clearance within the valvetrain 13.

The rocker arm assembly 26 includes an arm member 32, which includes a pad portion 34 configured to engage the poppet valve 24. The arm portion 32 defines a recess 36 within which a roller assembly 38 is at least partially contained. The roller assembly 38 is in selective engagement with the low-lift cam 22. Roller assemblies 40 and 42, disposed on either side of the arm member 32, are in engagement with a respective one of the first and second high-lift cams 18 and 20. The roller assemblies 40 and 42 are rotatably supported by a generally cylindrical shaft member 44, shown in FIG. 1 with dashed lines. The roller assemblies 40 and 42 are preferably roller bearings. The shaft member 44 extends through the arm member 32, the roller assembly 38, and a coupling lever 46 and cooperates with a generally C-shaped or curved opening 48, shown in FIG. 3 and defined by the roller assembly 38, to allow relative motion between the roller assemblies 40 and 42 and the arm member 32. The coupling lever 46 is mounted to the shaft member 44 and is operable to selectively lock or retain the shaft member 44, and therefore the roller assemblies 40 and 42, with respect to the arm member 32 for unitary movement translational movement therewith.

The rocker arm assembly 26 includes a spring lever 50, which is pivotably mounted with respect to the arm member 32 and in engagement with the roller assembly 40 and shaft member 44. A spring member 52 is disposed between the arm member 32 and the spring lever 50 and is operable to bias the shaft member 44 and roller assembly 40 toward the first high-lift cam 18. Similarly, a spring lever 54 is pivotably mounted with respect to the arm member 32 and in engagement with the roller assembly 42 and shaft member 44. A spring member 56 is disposed between the arm member 32 and the spring lever 54 and is operable to bias the shaft member 44 and roller assembly 42 toward the second high-lift cam 20. A pin 58 retains the spring levers 50 and 54 and the spring members 52 and 56 with respect to the arm member 32.

The rocker arm assembly 26 is capable of selectively operating in a high-lift mode, wherein the poppet valve 24 is opened to a first predetermined maximum valve lift, and a low-lift mode, wherein the poppet valve 24 is opened to a second predetermined maximum valve lift, which is of lesser magnitude than that of the first predetermined maximum valve lift. As such, the rocker arm assembly 26 may be characterized as having two-step functionality.

Figure 3:
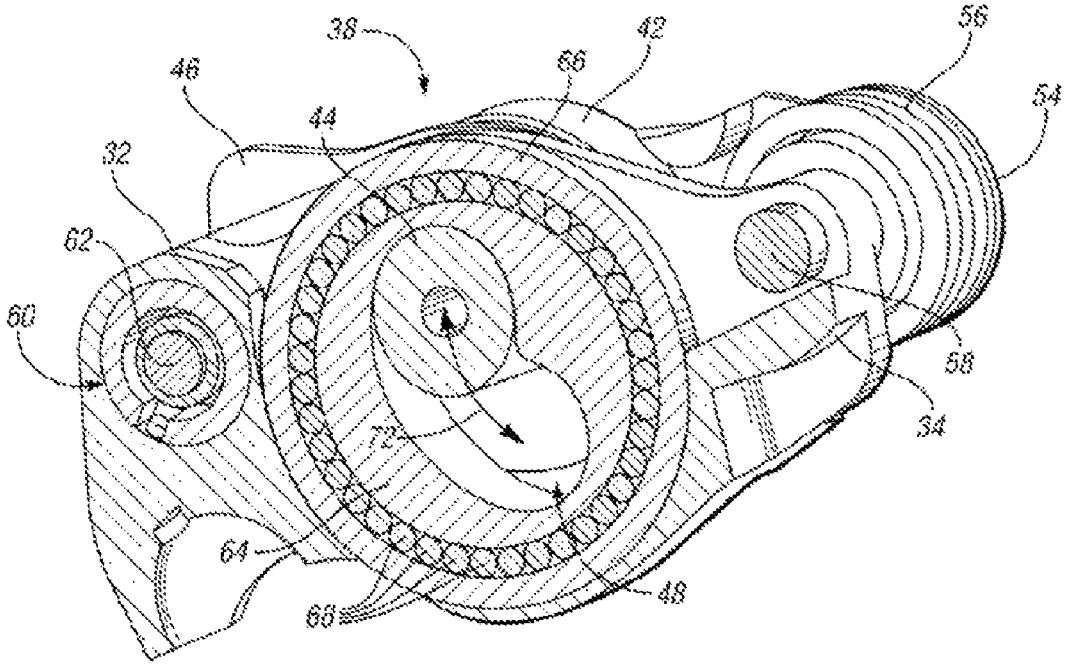
FIG. 3 is a perspective cross sectional view of the rocker arm assembly of FIG. 2, reoriented to better illustrate a roller assembly defining a generally C-shaped opening consistent with the present invention.

During operation of the valvetrain 13, with the coupling lever 46 unlocked, the first and second high-lift cams 18 and 20 engage the respective roller assemblies 40 and 42, thereby causing the shaft member 44 to translate within the generally C-shaped opening 48, shown in FIG. 3. Therefore, the high-lift cams 18 and 20 do not transfer force through the rocker arm assembly 26 to bias the poppet valve 24 to the first predetermined maximum valve lift. This mode of operation may be referred to as a "lost motion" mode of operation. In the lost motion mode of operation, the low-lift cam 22 engages the roller assembly 38 to selectively bias the rocker assembly 26 to open the poppet valve 24 to the second predetermined maximum valve lift. In a "high-lift" mode of operation, the coupling lever 46 is locked, thereby retaining the shaft member 44 with respect to the arm member 32 and preventing translation of the shaft member 44 within the generally C-shaped opening 48, shown in FIG. 3. The high-lift cams 18 and 20 engage the respective roller assemblies 40 and 42 to selectively bias the rocker assembly 26 to open the poppet valve 24 to the first predetermined maximum valve lift.

Figure 2:
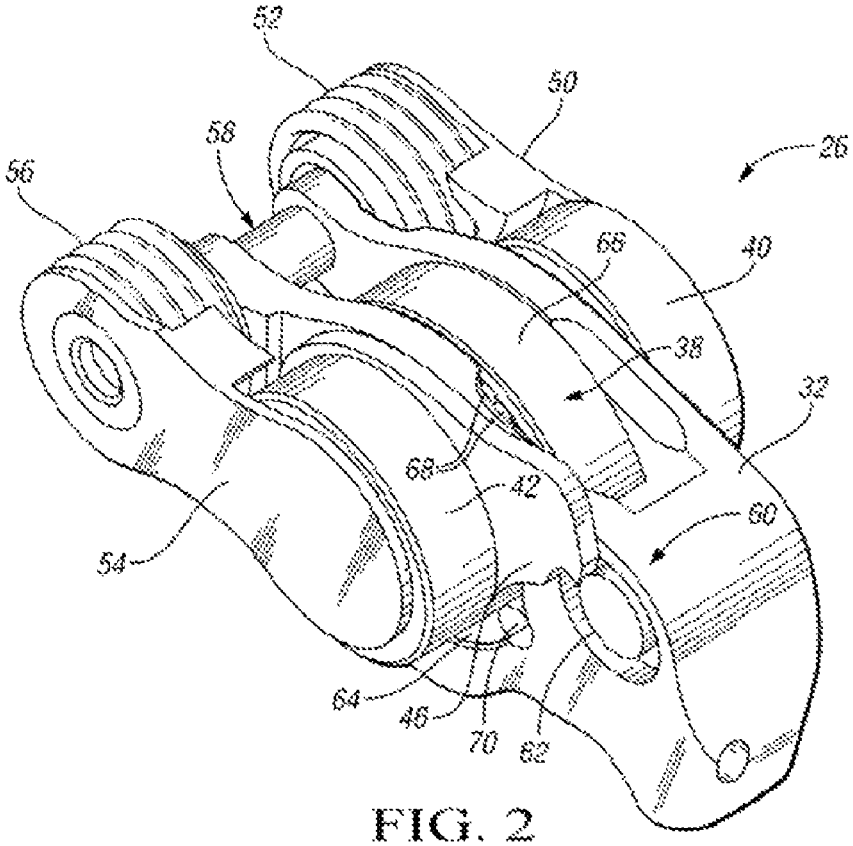
FIG. 2 is a perspective view of the rocker arm assembly of FIG. 1 further illustrating aspects of the present invention.

Referring now to FIG. 2, there is shown a perspective view of the rocker arm assembly 26 of FIG. 1. A hydraulically activated latch assembly 60 is housed within the arm member 32 and includes a selectively extendable pin 62, shown in the retracted position in FIG. 2. The pin 62 may be selectively extended by hydraulic pressure provided to the latch assembly 60 by the lash adjuster 30, shown in FIG. 1. With the pin 62 in the retracted position, the coupling lever 46 is unlocked, thereby allowing relative translational movement between the shaft member 44 and roller assemblies 40 and 42 with respect to the arm member 32. Therefore, with the pin 62 retracted, the lost motion mode of operation is achieved. With the pin 62 in the extended position, the coupling lever 46 is locked, thereby retaining the shaft member 44 and the roller assemblies 40 and 42 with respect to the arm member 32. Therefore, with the pin 62 extended, the high-lift mode of operation is achieved.

The roller assembly 38 includes an inner race 64 with an outer race 66 coaxially disposed and spaced from the inner race 64. A plurality of roller elements 68 are disposed between the inner race 64 and the outer race 66. A key or pin 70 restricts the rotation of the inner race 64 with respect to the arm member 32.

Referring to FIG. 3, there is shown a perspective cross sectional view of the rocker arm assembly 26 of FIG. 2, reoriented to better illustrate the roller assembly 38 defining the generally C-shaped opening 48 consistent with the present invention. As illustrated in FIG. 3, the generally C-shaped opening 48 is defined by the inner race 64 of the roller assembly 38. During the high-lift mode of operation, i.e. the coupling lever 46 is locked, the shaft member 44 remains fixed within the upper portion of the generally C-shaped opening 48, as shown in FIG. 3. However, during the lost motion mode of operation, i.e. the coupling lever 46 is unlocked, the shaft member 44 will translate within the generally C-shaped opening 48. The path in which the shaft member 44 will travel is indicated in FIG. 3 as arrow 72.

By forming the generally C-shaped opening 48 within the inner race 64 of the roller assembly 38, the rocker arm assembly 26 may provide two-step functionality with reduced manufacturing complexity. The manufacturing complexity may further be reduced by providing the generally cylindrical shaft member 44 sufficiently configured to selectively translate within the generally C-shaped opening 48. A generally cylindrical shape is preferred for the shaft member 44 compared with other forms, such as an eccentric shape.

While the best modes for carrying out the invention have been described in detail, those familiar with the art to which this invention relates will recognize various alternative designs and embodiments for practicing the invention within the scope of the appended claims.

The invention claimed is:

1. A two-step rocker arm assembly comprising:

an arm member;

a first roller assembly rotatably mounted with respect to said arm member and defining a generally curved opening;

a shaft member;

a second roller assembly rotatably supported by said shaft member;

wherein said shaft member extends at least partially into said generally curved opening, said shaft member being selectively translatable within said generally curved opening to guide said second roller assembly with respect to said arm member; and a coupling lever mounted with respect to said shaft member and operable to selectively retain said shaft member with respect to said arm member for unitary movement therewith.

2. The two-step rocker arm assembly of claim 1, further comprising:

a first spring lever pivotably mounted with respect to said arm member and engaged with at least one of said shaft member and said second roller assembly; and a first spring member disposed between said first spring lever and said arm member and operable to bias said shaft member with respect to said arm member.

3. The two-step rocker arm assembly of claim 1, further comprising a third roller assembly rotatably supported by said shaft member.

4. The two-step rocker arm assembly of claim 3, further comprising:

a second spring lever pivotably mounted with respect to said arm member and engaged with at least one of said shaft member and said third roller assembly; and a second spring member disposed between said second spring lever and said arm member and operable to bias said shaft member with respect to said arm member.

5. The two-step rocker arm assembly of claim 3, wherein said third roller assembly is a roller bearing.

6. The two-step rocker arm assembly of claim 1, wherein said first roller assembly includes:

an inner race;

an outer race coaxially disposed with respect to, and spaced from said inner race;

a plurality of roller elements disposed between said inner race and said outer race; and wherein said inner race defines said generally curved opening.

7. The two-step rocker arm assembly of claim 6, wherein said inner race is fixed with respect to said arm member.

8. The two-step rocker arm assembly of claim 1, further comprising a latch assembly operable to selectively engage said coupling lever to selectively retain said shaft member to said arm member for unitary movement therewith.

9. The two-step rocker arm assembly of claim 8, wherein said latch assembly includes a hydraulically actuated pin.

10. The two-step rocker arm assembly of claim 6, wherein said second roller assembly is a roller bearing.

11. A valvetrain comprising:

a camshaft having a low-lift cam and a high-lift cam;

a two-step rocker arm assembly including:

an arm member;

a first roller assembly rotatably mounted with respect to said arm member and defining a generally C-shaped opening;

a shaft member;

a second roller assembly rotatably supported by said shaft member;

wherein said shaft member extends at least partially into said generally C-shaped opening, said shaft member being selectively translatable within said generally C-shaped opening to guide said second roller assembly with respect to said arm member;

a coupling lever mounted with respect to said shaft member;

a selectively engageable latch assembly operable to selectively engage said coupling lever to selectively retain said shaft member with respect to said first arm member for unitary movement therewith;

wherein said low-lift cam is in selective engagement with said first roller assembly and said high lift cam is engaged with said second roller assembly;

wherein said hi-lift cam is configured to actuate said two-step rocker arm assembly when said latch assembly engages said coupling lever; and wherein said low-lift cam is configured to actuate said two-step rocker arm assembly when said latch assembly disengages said coupling lever.

12. The valvetrain of claim 11, further comprising another high lift cam disposed on said camshaft and positioned such that said another high-lift cam and said high-lift cam are on opposite sides of said low-lift cam and wherein said two-step rocker arm assembly further includes a third roller assembly rotatably supported by said shaft member, wherein said another high-lift cam engages said third roller assembly.

13. The valvetrain of claim 12, wherein said two-step rocker assembly further includes:

a first spring lever pivotably mounted with respect to said first arm member and engaged with at least one of said shaft member and said second roller assembly; and a first spring member disposed between said first spring lever and said arm member and operable to bias said shaft member with respect to said arm member;

a second spring lever pivotably mounted with respect to said arm member and engaged with at least one of said shaft member and said third roller assembly; and a second spring member disposed between said second spring lever and said arm member and operable to bias said shaft member with respect to said arm member.

14. The valvetrain of claim 12, wherein at least one of said second roller assembly and said third roller assembly is a roller bearing.

15. The valvetrain of claim 11, wherein said first roller assembly includes:

an inner race;

an outer race coaxially disposed with respect to, and spaced from said inner race;

a plurality of roller elements disposed between said inner race and said outer race; and wherein said inner race defines said generally C-shaped opening.

16. The valvetrain of claim 11, further comprising:

a poppet valve; and wherein said arm member includes a pad configured to engage said poppet valve.

17. A two-step rocker arm assembly for use with an internal combustion engine, the two-step rocker arm assembly comprising:

an arm member;

a first roller assembly rotatably mounted with respect to said arm member and defining a generally C-shaped opening;

a shaft member;

second and third roller assemblies rotatably supported by said shaft member and disposed on opposite sides of said arm member;

wherein said shaft member extends through said generally C-shaped opening, said shaft member being selectively translatable within said generally C-shaped opening to guide said second and third roller assemblies with respect to said arm member; and a coupling lever mounted with respect to said shaft member and operable to selectively retain said shaft member with respect to said arm member for unitary movement therewith.

18. The two-step rocker arm assembly of claim 17, wherein said first roller assembly includes:

an inner race;

an outer race coaxially disposed with respect to, and spaced from said inner race;

a plurality of roller elements disposed between said inner race and said outer race; and wherein said inner race defines said generally C-shaped opening.

19. The two-step rocker arm assembly of claim 17, further comprising:

at least one spring lever pivotably mounted with respect to said arm member and engaged with at least one of said shaft member and said second roller assembly; and at least one spring member disposed between said at least one spring lever and said arm member and operable to bias said shaft member with respect to said arm member.

20. The two-step rocker arm assembly of claim 17, further comprising a latch assembly operable to selectively engage said coupling lever to selectively retain said shaft member to said arm member for unitary movement therewith.

* * * * *